US006061540A

United States Patent [19]

Takeda

[11] Patent Number: 6,061,540

[45] Date of Patent: May 9, 2000

[54] DEVELOPING DEVICE FOR AN IMAGE FORMING APPARATUS

[75] Inventor: Yusuke Takeda, Kanagawa, Japan

[73] Assignee: Ricoh Company, Ltd., Tokyo, Japan

[21] Appl. No.: 09/205,721

[22] Filed: Dec. 4, 1998

[30] Foreign Application Priority Data

Dec. 5, 1997 [JP] Japan ..... 9-350258

[51] Int. Cl.[7] ..... G03G 15/00; B05C 11/00

[52] U.S. Cl. ..... 399/237; 118/60

[58] Field of Search ..... 118/60, 106, 107, 118/110, 244, 255, 665; 399/222, 223, 224, 225, 226, 227, 233, 234, 236, 237, 235, 240, 29

[56] References Cited

U.S. PATENT DOCUMENTS

| | | | |
|---|---|---|---|
| 3,907,423 | 9/1975 | Hayashi et al. | 399/249 |
| 4,202,620 | 5/1980 | Klavan et al. | 399/239 |
| 4,504,138 | 3/1985 | Kuehnle et al. | 399/240 |
| 5,291,251 | 3/1994 | Storlie et al. | 399/147 |
| 5,666,616 | 9/1997 | Yoshino et al. | 399/240 |
| 5,708,938 | 1/1998 | Takeuchi et al. | 399/250 |

*Primary Examiner*—Arthur T. Grimley
*Assistant Examiner*—Hoang Ngo
*Attorney, Agent, or Firm*—Oblon, Spivak, McClelland, Maier & Neustadt, P.C.

[57] ABSTRACT

A developing device for an image forming apparatus of the present invention is capable of enhancing image quality by making the thickness of a film of developing liquid on a photoconduct element uniform after development. Development is effected under particular conditions matching with, e.g., the properties of the developing liquid.

3 Claims, 2 Drawing Sheets

DEVELOPING DEVICE FOR AN IMAGE FORMING APPARATUS

BACKGROUND OF THE INVENTION

The present invention relates to an image forming apparatus including an image carrier in the form of, e.g., a photoconductive drum or a photoconductive belt and more particularly to a developing device included in an image forming apparatus for developing an electrostatic latent image formed on the surface of an image carrier by causing a thin layer of developing liquid to contact the latent image.

It is a common practice with a developing device of the type using a developing liquid, particularly a viscous developing liquid, to cause the liquid to form a thin layer on a developer carrier implemented as a roller or a belt. The developing liquid on the developer carrier is brought into contact with the surface of a drum, belt or similar photoconductive element, thereby developing a latent image formed on the above surface.

The problem with the developing device of the type described is that the film formed on the photoconductive element by the developing liquid after development is not uniform in thickness in the axial direction of the photoconductive element. This is ascribable to fine undulation, generally referred to as ribs, occurring in the axial direction of the photoconductive element and dependent on the viscosity and other properties of the liquid, the linear velocity and configurations of the image carrier and photoconductive element, etc. Should a toner image be transferred to a paper or similar recording medium under the above condition, there would occur the deformation of thin lines, contamination of background and other various troubles deteriorating image quality.

SUMMARY OF THE INVENTION

It is therefore an object of the present invention to provide a developing device for an image forming apparatus capable of enhancing image quality by making the thickness of a film of developing liquid on a photoconductive element uniform after development.

A developing device of the present invention causes a developing roller to rotate in the same direction and at the same linear velocity as a photoconductive drum, causes a developing liquid to form a thin layer on the developing roller and contact a latent image electrostatically formed on the photoconductive drum, and transfers the developing liquid from the developing roller to the photoconductive drum to thereby develop the latent image. Assume that the developing liquid has a viscosity $\mu$ and a surface tension $\sigma$, that the developing roller and photoconductive drum move at a linear velocity V, that the photoconductive drum and developing roller respectively have a radius $R_1$ and a radius $R_2$, and that the thickness of the developing liquid deposited on the developing roller moved away from a nip between the developing roller and the photoconductive drum and the thickness of the developing liquid deposited on the photoconductive drum moved away from the nip have a total thickness h, then following conditions are satisfied:

$$Ca<55\cdot(h/R)+0.44$$

$$Ca=\mu\cdot V/\sigma$$

$$R=R_1\cdot R_2/(R_1+R_2)$$

Conditions similar to the above conditions are satisfied even when the developing roller is replaced with an endless developing belt or when the photoconductive drum is replaced with an endless photoconductive belt.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

A developing device of the present invention will be outlined first. The developing device is applicable to a copier, facsimile apparatus, printer or similar electrophotographic image forming apparatus and develops a latent image electrostatically formed on a photoconductive element with a viscous developing liquid. The developing device operates under particular conditions for preventing a film formed of the liquid on a photoconductive element after development from becoming uneven in the axial direction of the photoconductive element.

Assume that the above developing liquid has a viscosity $\mu$ and a surface tension $\sigma$, that a developing roller and a photoconductive drum each has a linear velocity V, that the drum and developing roller respectively have a radius $R_1$ and a radium $R_2$, and that the total thickness of the liquid on the roller and drum moved away from a nip between the roller and the drum is h. Then, the developing roller is rotated in the same direction and at the same peripheral speed as the drum under the following conditions:

$$Ca<55\cdot(h/R)+0.04$$

$$Ca=\mu\cdot V/\sigma$$

$$R=R_1\cdot R_2/(R_1+R_2)$$

A thin film formed on the developing roller by the liquid is brought into contact with the drum carrying a latent image thereon. As a result, the liquid is transferred from the roller to the drum in order to develop the latent image.

Figure 1:
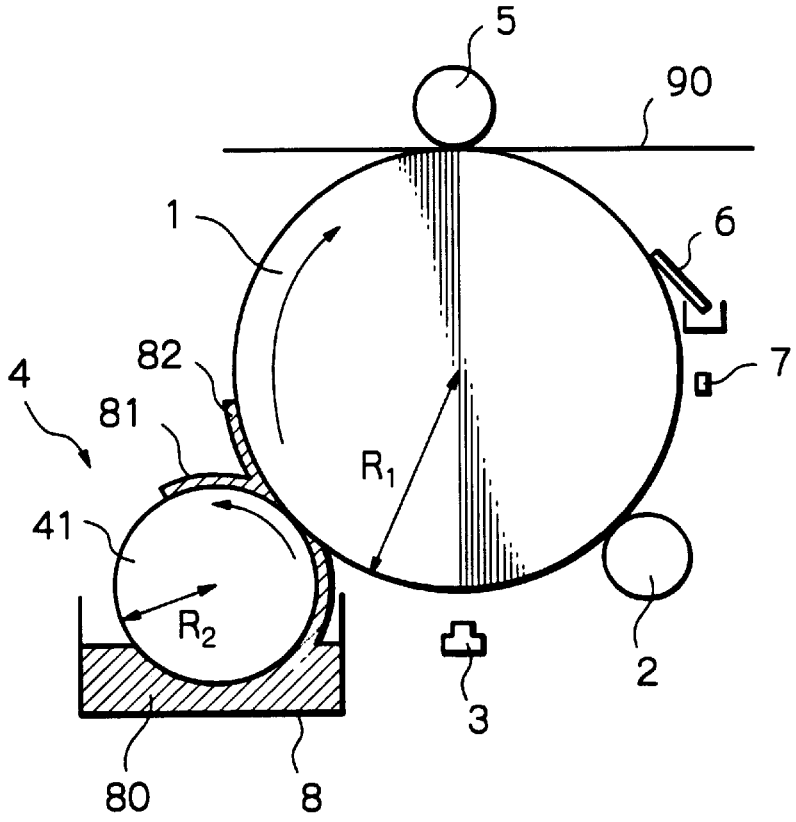
FIG. 1 shows a developing device embodying the present invention together with an image forming apparatus using it.

Referring to FIG. 1, a developing device embodying the present invention is shown together with an image forming apparatus using it. As shown, the apparatus includes a photoconductive drum 1 having a radius $R_1$, a charge roller 2, an optical unit 3 for exposure, a developing device 4, a transfer roller 5, a cleaning blade 6, and a cleaning lamp 7. The charge roller 2 uniformly charges the surface of the drum 1. The optical unit 3 exposes the charged surface of the drum 1 in accordance with image data received from a scanner, not shown, or a host, not shown, thereby electrostatically forming a latent image.

The developing device 4 includes, e.g., a tank 8 and a developing roller 41. The tank 8 stores a viscous developing liquid 80 consisting of a dielectric carrier liquid and toner dispersed in the carrier liquid. The developing liquid 80 has a viscosity $\mu$ and a surface tension $\sigma$. The developing roller 41 rotates in the same direction and at the same linear velocity V as the drum 1 while conveying the liquid 80 from the tank 8 to a nip where it contacts the drum 1. As a result, the liquid 80 contacts the drum 1 and develops the latent image to thereby form a corresponding toner image.

At the outlet of the above nip, the developing liquid 80 is separated into a liquid 81 deposited on the developing roller 41 and a liquid 82 deposited on the drum 1. The liquids 81 and 82 have thicknesses $h_1$ and $h_2$, respectively. The sum of the thicknesses $h_1$ and $h_2$ is h. The developing roller 41 has a radius $R_2$.

The transfer roller 5 transfers the toner image from the drum 1 to a paper or similar recording medium 90. The cleaning blade 6 removes the liquid 82 left on the drum 1 after the image transfer. The cleaning lamp 7 discharges the drum 1 after the image transfer in order to prepare the drum 1 for the next image formation.

Assume $R=R_1 \cdot R_2/(R_1+R_2)$. Then, the capillary number ($Ca=\mu \cdot V/\sigma$), the radius $R_1$ of the drum 1, the radius $R_2$ of the developing roller 41 and the sum h of the thicknesses $h_1$ and $h_2$ of the liquids 82 and 81 have a relation represented by a curve A in FIG. 2. As shown, the capillary number Ca increases with an increase in a ratio h/R. The thickness of the liquid 82 on the drum 1 is not uniform in a range B shown in FIG. 2, but uniform in a range C shown in FIG. 2.

Figure 2:
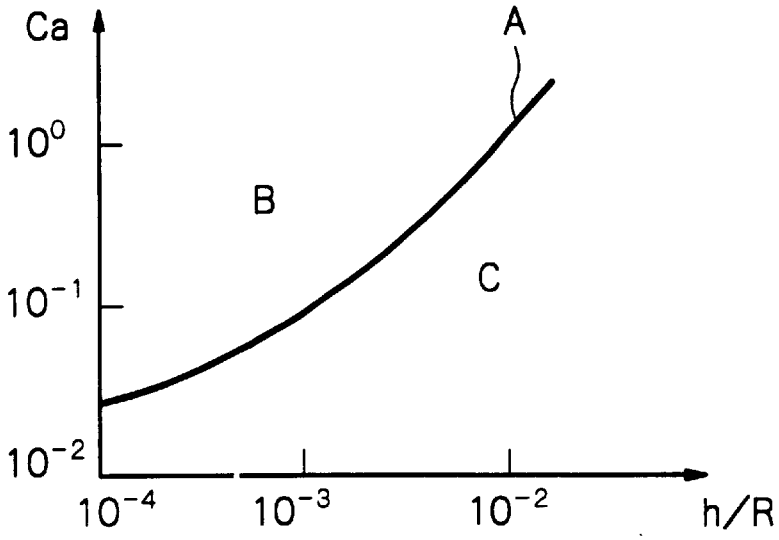
FIG. 2 is a graph showing a relation between the capillary number Ca and a ratio h/R which will be described later.

The curve or boundary A of FIG. 2 can be approximated by:

$$Ca=55\cdot(h/R)+0.04$$

Therefore, conditions to be satisfied are:

$$Ca<55\cdot(h/R)+0.04$$

$$Ca=\mu\cdot V/\sigma$$

$$R=R_1\cdot R_2/(R_1+R_2)$$

The developing roller 41 is caused to rotate in the same direction and at the same linear velocity V as the drum 1 in such a manner as to satisfy the above conditions. The developing liquid 80 forms a thin layer on the developing roller 41 and contacts the drum 1 carrying a latent image thereon. Consequently, the liquid 80 is transferred from the developing roller 41 to the drum 1, developing the latent image. The above particular conditions prevent ribs from appearing on the drum 1 and thereby insure uniform image density.

In a specific example of the illustrative embodiment, the developing liquid 80 has a viscosity $\mu$ of 0.1 ($Nsm^{-2}$) and a surface tension $\sigma$ of 0.02 ($Nm^{-1}$). The drum 1 and developing roller 41 rotate at a linear velocity V of 0.1 ($ms^{-1}$). The liquid 80 has a total thickness h of $2\times10^{-5}$ (m). The drum 1 has a radius R1 of 0.02 (m). Under these conditions, the radius $R_2$ of the developing roller 41 satisfying the previously stated three relations is less than 0.0026 (m). The radius of the roller 41 implementing desirable images is therefore less than 5 (mm) inclusive.

While the diameter of the developing roller 41 is determined in the above example, the viscosity $\mu$ and surface tension $\sigma$ of the developing liquid 80 and the linear velocity V of the drum 1 and roller 41 can be determined by similar calculation.

Figure 3:
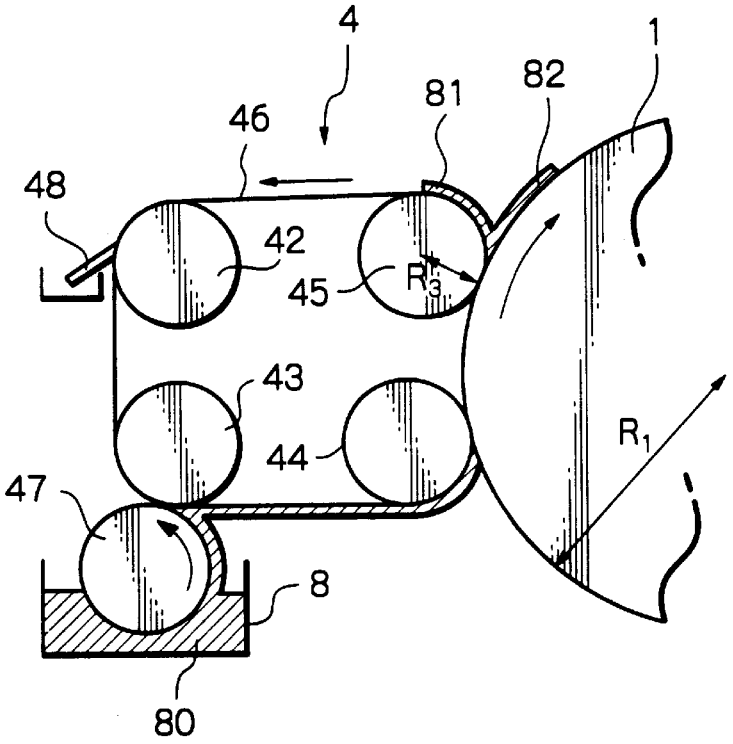
FIGS. 3 and 4 each shows a particular alternative embodiment of the present invention.
Figure 4:
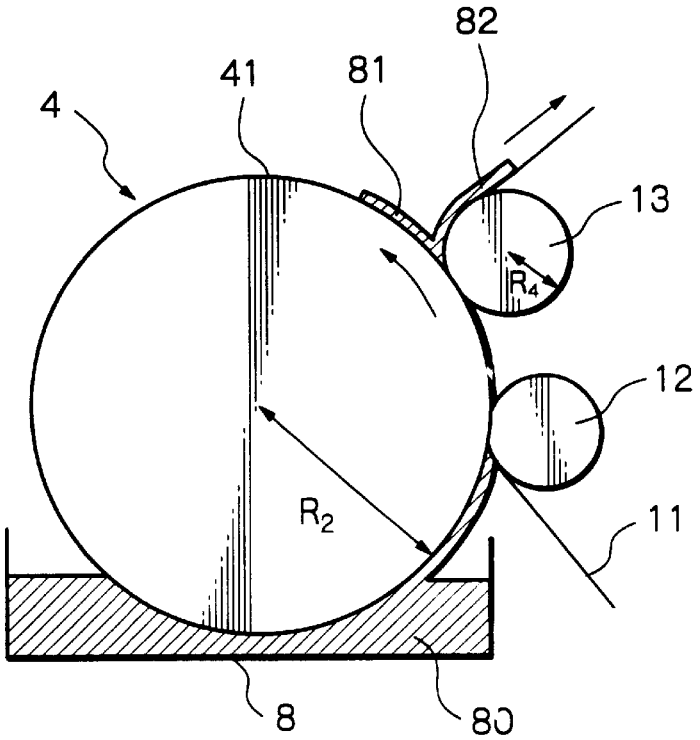

FIG. 3 shows an alternative embodiment of the present invention. As shown, a developing device 4 includes a developing belt 46 in place of the developing roller 41. The belt 46 is passed over tension rollers 42 and 43 and support rollers 44 and 45. There are also shown in FIG. 4 an applicator roller 47 and a belt cleaning blade 48 in addition to the tank 8 storing the developing liquid 80. The tension rollers 42 and 43 apply a preselected degree of tension to the belt 46 in cooperation with the support rollers 44 and 45. The support rollers 44 and 45 hold the belt 46 in contact with the drum 1 over a preselected length. The belt 46 rotates in the same direction as the drum 1 at a speed V equal to the linear velocity V of the drum 1. The applicator roller 47 applies the developing liquid 80 to the belt 46. Consequently, the liquid 80 is transferred from the belt 46 to the drum 1, developing the latent image formed on the drum 1. The applicator roller 47 applies the liquid 80 to the belt 46 in the form of a layer having a uniform thickness. The belt cleaning blade 48 removes the liquid 81 left on the belt 46 after the development.

The radius of curvature of the belt 46, as measured at the outlet of the nip between the belt 46 and the drum 1, is substantially equal to the radius $R_3$ of the support roller 45. In this sense, the belt 46 is assumed to have a radius of curvature $R_3$ at the outlet of the above nip. The occurrence of ribs depends on the condition at the outlet of the nip. Therefore, the belt 46 is rotated in the same direction and at the same linear velocity V as the drum 1 in such a manner as to satisfy the following relations:

$$Ca<55\cdot(h/R)+0.04$$

$$Ca=\mu\cdot V/\sigma$$

$$R=R_1\cdot R_3/(R_1+R_3)$$

The liquid 80 forms a thin layer on the belt 46 and contacts a latent image formed on the drum 1. As a result, the liquid 80 is transferred from the belt 46 to the drum 1 in order to develop it. This successfully provides the resulting image with uniform density.

FIG. 4 shows another alternative embodiment of the present invention. As shown, this embodiment is generally similar to the embodiment of FIG. 1 except that a photoconductive belt 11 is substituted for the photoconductive drum 1. The photoconductive belt 11 is coated with, e.g., OPO (Organic Photo Conductor) and held in contact with support rollers 12 and 13 over a preselected length. Assume that the belt 11 has a radius of curvature equal to the radius $R_4$ of the support roller 13, as measured at the outlet of a nip between the belt 11 and the developing roller 41. Then, images with uniform density are achievable if development is effected under the following conditions:

$$Ca<55\cdot(h/R)+0.04$$

$$Ca=\mu\cdot V/\sigma$$

$$R=R_4\cdot R_2/(R_4+R_2)$$

Various modifications will become possible for those skilled in the art after receiving the teachings of the present disclosure without departing from the scope thereof.

What is claimed is:

1. In a developing device for causing a developing roller to rotate in a same direction and at a same linear velocity as a photoconductive drum, causing a developing liquid to form a thin layer on said developing roller and contact a latent image electrostatically formed on said photoconductive drum and transferring said developing liquid from said developing roller to said photoconductive drum to thereby develop said latent image, assuming that said developing liquid has a viscosity $\mu$ and a surface tension $\sigma$, that said developing roller and said photoconductive drum move at a linear velocity V, that said photoconductive drum and said developing roller respectively have a radius $R_1$ and a radius $R_2$, and that a thickness of the developing liquid deposited on said developing roller moved away from a nip between said developing roller and said photoconductive drum and a thickness of the developing liquid deposited on said photoconductive drum moved away from said nip have a total thickness h, then following conditions are satisfied:

$$Ca<55\cdot(h/R)+0.44$$

$$Ca=\mu\cdot V/\sigma$$

$$R=R_1\cdot R_2/(R_1+R_2).$$

2. In a developing device for causing an endless developing belt to rotate in a same direction and at a same linear velocity as a photoconductive drum, causing a developing liquid to form a thin layer on said developing belt and contact a latent image electrostatically formed on said photoconductive drum, and transferring said developing liquid from said developing belt to said photoconductive drum to thereby develop said latent image, assuming that said developing liquid has a viscosity $\mu$ and a surface tension $\sigma$, that said developing belt and said photoconductive drum move at a linear velocity V, that said photoconductive drum has a radius $R_1$, that said developing belt has a radius of curvature $R_3$ as measured at an outlet of a nip where said developing belt and said photoconductive drum contact, and that a thickness of the developing liquid deposited on said developing belt moved away from said and a thickness of the developing liquid deposited on said photoconductive drum moved away from said nip have a total thickness h, then following conditions are satisfied:

$$Ca<55\cdot(h/R)+0.44$$

$$Ca=\mu\cdot V/\sigma$$

$$R=R_1\cdot R_3/(R_1+R_3).$$

3. In a developing device for causing a developing roller to rotate in a same direction and at a same linear velocity as an endless photoconductive belt, causing a developing liquid to form a thin layer on said developing roller and contact a latent image electrostatically formed on said photoconductive belt, and transferring said developing liquid from said developing roller to said photoconductive belt to thereby develop said latent image, assuming that said developing liquid has a viscosity $\mu$ and a surface tension $\sigma$, that said developing roller and said photoconductive belt move at a linear velocity V, that said photoconductive belt has a radius of curvature $R_4$ as measured at an outlet of a nip where said developing roller and said photoconductive belt contact each other, that said developing roller has a radius $R_2$, and that a thickness of the developing liquid deposited on said developing roller moved away from said nip and a thickness of the developing liquid deposited on said photoconductive belt moved away from said nip have a total thickness h, then following conditions are satisfied:

$$Ca<55\cdot(h/R)+0.44$$

$$Ca=\mu\cdot V/\sigma$$

$$R=R_4\cdot R_2/(R_4+R_2).$$

* * * * *